United States Patent [19]

Kulesza et al.

[11] 4,191,374

[45] Mar. 4, 1980

[54] PROJECTILE RETURN APPARATUS WITH BALL TARGET AREA

[75] Inventors: Ralph J. Kulesza, Chicago; John R. Wildman, North Riverside; Joseph M. Burck, Glenview; Burton C. Meyer, Downers Grove; Walter J. Wozniak, Addison, all of Ill.

[73] Assignee: Marvin Glass & Associates, Chicago, Ill.

[21] Appl. No.: 876,410

[22] Filed: Feb. 10, 1978

[51] Int. Cl.[2] ..... A63B 63/00

[52] U.S. Cl. ..... 273/30; 124/78; 273/395

[58] Field of Search ..... 273/103, 26 D, 29 A, 273/30, 125 A, 48, 127 C, 49; 124/49, 51 R, 1, 78

[56] References Cited

U.S. PATENT DOCUMENTS

| | | | |
|---|---|---|---|
| 1,899,442 | 2/1933 | Hess | 273/39 |
| 2,313,409 | 3/1943 | Walker | 273/29 A |
| 2,630,322 | 3/1953 | Endriss | 273/49 |
| 2,705,945 | 4/1955 | Cavalier | 124/6 |
| 2,765,171 | 10/1956 | Cook | 273/30 |
| 3,036,833 | 5/1962 | Wilson | 273/103 |
| 3,084,680 | 4/1963 | Goldfarb et al. | 124/16 |
| 3,404,669 | 10/1968 | Null | 124/49 |
| 3,548,801 | 10/1967 | Lohr | 273/101 |
| 3,604,409 | 9/1971 | Doeg | 273/26 D |
| 3,713,658 | 1/1973 | Cook | 124/1 |
| 3,948,512 | 4/1976 | Worthington | 273/29 A X |
| 3,992,006 | 11/1976 | Barlow | 273/85 F |
| 4,025,071 | 5/1977 | Hodges | 273/29 A |

*Primary Examiner*—Richard C. Pinkham
*Assistant Examiner*—Lawrence E. Anderson
*Attorney, Agent, or Firm*—Mason, Kolehmainen, Rathburn & Wyss

[57] ABSTRACT

A game apparatus for use with projectiles, such as table tennis balls, including a ball receiving housing having a ball entrance and ball guide apparatus leading to a target area to receive balls propelled toward it by a player or players. Balls arriving at the target area are received by ball propelling apparatus which return or eject the balls toward the player through ball ejection guiding passage apparatus and an ejection opening. The game may be played by a single player for practice or by several players to simulate tennis, table tennis, handball or the like.

8 Claims, 5 Drawing Figures

PROJECTILE RETURN APPARATUS WITH BALL TARGET AREA

BACKGROUND AND SUMMARY OF THE INVENTION

This invention relates to apparatus for the entertainment of players and the development of dexterity, coordination and skill, especially for a player or players in playing games similar to table tennis, paddle tennis, and the like. It is suitable for use as a practice device by a single player or for playing a game of skill by two or more players. Various projectile launching or return devices are shown in U.S. Pat. Nos. 2,705,945; 2,765,171; 3,084,680 and 3,548,801. It will be described particularly as used in connection with a game comparable to table tennis.

Table tennis is played on a table equipped with a central transverse net and the players use paddles to serve and then bat a table tennis ball back and forth over the net. The usual rules of the game require service of the ball on a bounce over the net onto certain areas at the opponents side of the table followed by subsequent return back and forth across the net so as to land on the table at the opponents side of the table before being returned by the opponent. Players develop varying skills in hitting and returning the ball and considerable dexterity and coordination is a requirement for excellent play. The present invention provides an apparatus enabling players to develop their skills and it also provides an apparatus that can be used by two or more players to engage in a game somewhat comparable to table tennis.

It is an object of the present invention to provide a new and improved apparatus for developing and improving skills and enabling skilled and unskilled players to play games similar to table tennis.

An exemplary embodiment of the game apparatus includes a generally box-like housing having at its front end an entrance for balls and connected by a first or entrance ball guiding means to a target area at which balls may be directed. The first guiding means comprises top and side walls that converge toward the target area while the bottom wall is inclined downwardly to the target area. The target area is of substantial width, many times the diameter of a ball. Ball propelling means are located at the region of and below the target area for the reception of balls and for returning them to the player so that they can be hit again. The propelling means may be a rapidly rotating roller, also of substantial width (preferably coextensive in width with the target area) spaced a distance slightly less than the diameter of a ball from an associated housing surface for a portion of its perimeter. A ball from the target area is received between the roller and surface for an arcuate length approximately equal to 90° and propelled at a relatively high, and adjustable, velocity through second or ejection ball guiding means back to the player or players. This second means is located below the first guide means and includes a plurality of vertically disposed longitudinally partition-like walls extending from the ball receiving and propelling region of the roller to a ball ejection opening at the front of the apparatus. The partition walls define discrete and different paths for the balls from different transverse regions of the propelling means to the players. The ejection opening includes a transverse deflector of substantial width and being angularly adjustable about a horizontal axis to vary the vertical angle at which the balls approach the player. The ball propelling rotor is rotated by an electric motor, the speed and composition of which may be varied to change the speed at which the balls are propelled or to accommodate different types of balls.

DETAILED DESCRIPTION OF THE INVENTION

Figure 1:
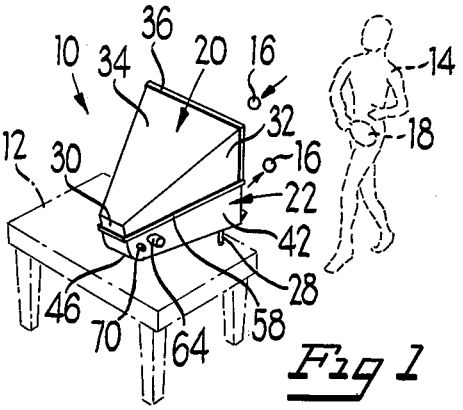
FIG. 1 is a perspective view of a game apparatus embodying the present invention mounted on a table and illustrating a player using it to play a game akin to table tennis.
Figure 4:
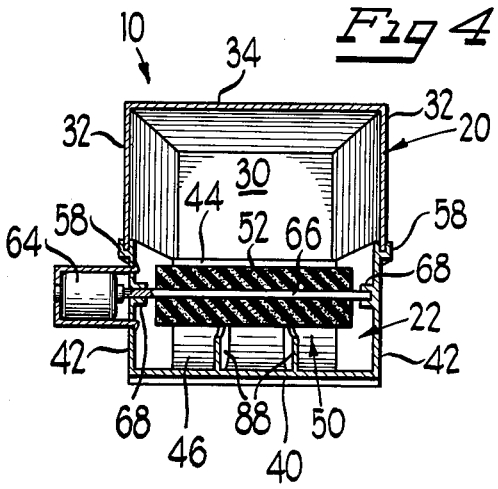
FIG. 4 is a transverse cross-sectional view taken along line 4—4 of FIG. 2.

Referring now to the drawings and first to FIG. 1, the game apparatus is illustrated as including a housing indicated as a whole by the reference numeral 10. It is shown mounted on a table 12 of suitable height so that it can be conveniently located to enable a player 14 to readily reach and hit the balls 16 with a paddle 18. Two balls are illustrated in play and associated arrows indicate that a lower ball has been propelled toward the player by the apparatus and an upper ball has been returned from the apparatus toward the player. It should be understood that a single ball can be used or more than the two illustrated can be used, depending upon the desires, the skill of the player or players, and the number of players. The balls may be of different colors for playing certain games devised by the players or suggested in the accompanying instructions.

The housing 10 comprises separable upper and lower portions 20 and 22, respectively, of which the former has a ball entrance opening 24 and the latter an ejection opening 26. The housing, as best shown in FIG. 1, is generally in the shape of a truncated cone or funnel lying on its side, with its front and larger end constituting the entrance opening. The housing is given a generally downward inclination to the rear by front supporting legs 28. The inclination is such that balls in the housing gravitate to the rear.

A ball target area 30 is located at the rear of the housing. It comprises a rear wall from which side walls 32 and a top 34 diverge forwardly and outwardly and terminate in a generally inverted U-shaped rim 36 that defines the major portion of ball entrance 24.

The lower housing portion 22 comprises an inclined bottom wall 40, side walls 42 and a rear wall 44, the upper portion of which forms, in effect, a continuation of target area 30. This portion is connected to bottom 40 by an elongated arcuate portion 46 constituting part of ball propelling means 50, which also includes an elongated cylindrical roller 52, further details of which will be described shortly. The housing includes an inclined intermediate partition 54 slidably mounted on opposed runners 56 at the insides of side walls 42 of the lower portion 22 at about the upper level of the roller 52. The lower part is provided with structure 58 defining a U-shaped upwardly groove in which the top 20 is mounted.

Figure 2:
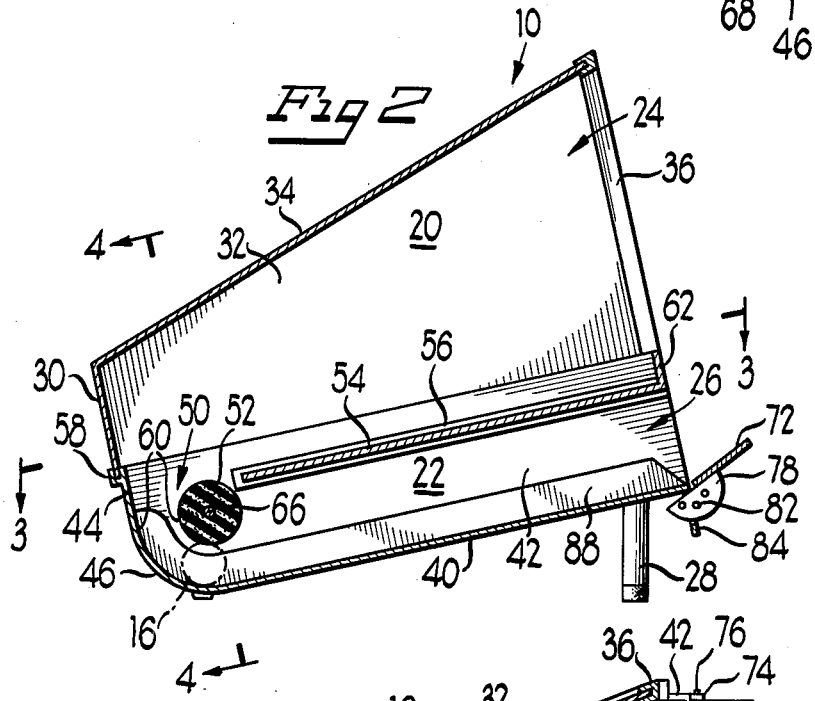
FIG. 2 is a central longitudinal vertical cross-sectional view of the apparatus.

The ball target area 30 has a width several times the diameter of a ball, as does the roller 52. A ball receiving or collection area or space 60 (see FIGS. 2 and 3) is provided between the rear of roller 52 and wall 44 below target area 30 at the top for receiving balls striking the target and falling into the space, or balls rolling or otherwise guided into the space by the top 34, side walls 32 and partition 54. These elements constitute a first ball guiding means for directing balls entering the housing through entrance 24 and either directly hitting target 32 or the walls and rolling down partition 54 which, in effect, constitutes a bottom wall for the first guiding means. It should be noted that the roller 52 frictionally engages balls rolling down partition 54 and carries them into the space 60 for action by the propelling means 50. The interior surfaces of the guiding means are preferably lined (not shown) to minimize bouncing of balls. Also an upstanding lip 62 may be provided at the front end of partition 54 to minimize the possibility of the balls rolling out of the housing.

The ball propelling means 50, which constitutes an important feature of the invention, includes the elongated cylindrical roller 52 extending substantially the full width of the ball collection area which, as noted earlier, is of substantial width. It is covered with or made of some frictional material of a nature and density frictionally to engage a ball 16 (see FIG. 2) and press it with sufficient pressure against the arcuate housing portion 46 to propel it toward the ejection opening 26 and the players. The spacing between the roller and wall portion 64 is such that balls are frictionally engaged between the two for a brief period and then released and propelled toward and through the ejection opening.

The ball propelling means 60 and ejection opening 26 are connected by what may be termed a second guiding means or discharge passage constituted by bottom 40 and sidewalls 42 of the bottom housing portion 22, the underside of partition 54, and terminating at the ejection opening 26. The two ball guiding means, i.e., the receiving and returning guide means, are thus vertically displaced and interconnected at the rear by the propelling means which reverses the direction of the balls as well as propels them.

The ball propelling means is continuously in operation when the apparatus is used. To this end, the roller 52 is continuously rotated by an electric motor 64 mounted on a sidewall 42 and driving a roller supporting shaft 66 suitably mounted on bearings 68 mounted on sidewalls 42. The motor is a variable speed motor controlled by an on-off and speed varying control of known type operable by knob 70.

In one embodiment of the invention designed for table tennis balls, the roller diameter was approximately two inches and the motor had a top speed of 7000 rpm. The roller was of relatively soft foam and the spacing between the roller and arcuate wall portion 46 was such that the ball was relatively tightly engaged but not deformed. For other types of balls, harder rollers of rubber or the like can be used.

The vertical angle of ball ejection is varied by selectively positioning the deflector 72 at the ball ejection opening 26. A convenient method of mounting the deflector is on end supports 74 on the housing (FIG. 3) and projecting pintles 76 on the deflector. The deflector is held in one of several angular positions by a semi-circular fixture 78 having several openings 80 for the selective reception of a pin 82 engageable with a wall or bracket 84 extending downwardly from the front end of the lower housing portion 44.

Figure 3:
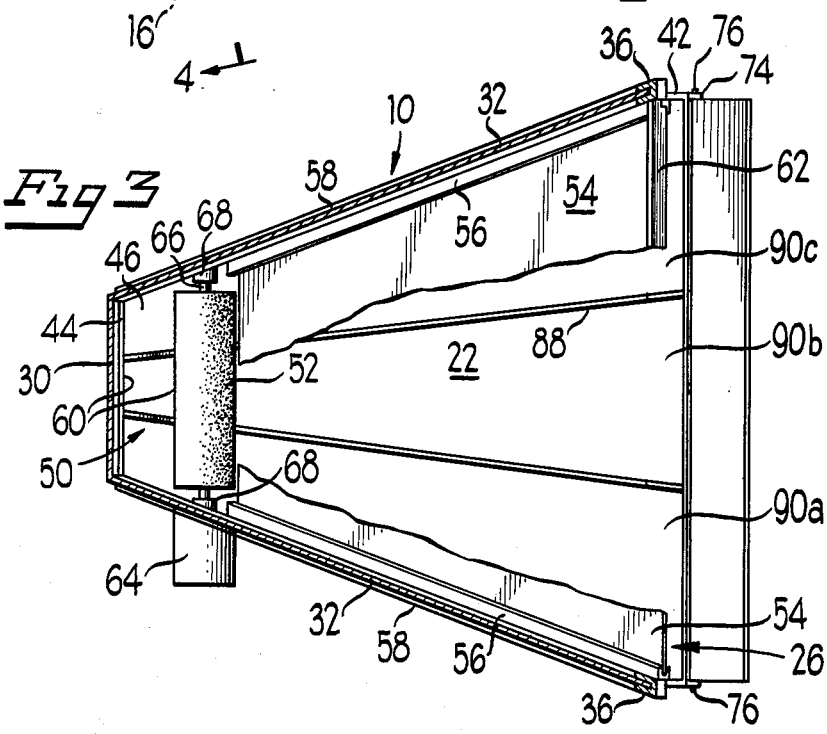
FIG. 3 is a generally horizontal cross-sectional view, partly broken away, taken along line 3—3 of FIG. 2.
Figure 5:
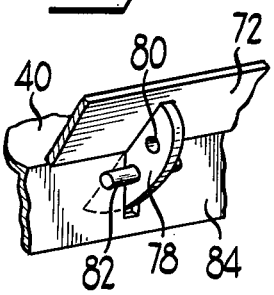
FIG. 5 is a fragmentary perspective view of the angularly adjustable deflector at the ball ejection opening for varying the angle of ejection of balls toward a player or players.

In order to better control or define the direction at which balls are ejected from opening 26, the ejection discharge passage may be divided by upstanding longitudinally extending dividers 88 mounted on bottom wall 40 into a number of definite and angularly spaced apart passages 90*a*, 90*b* and 90*c*, as best shown in FIG. 3. These dividers project upwardly toward a portion a distance sufficient to prevent the balls from being ejected in haphazard fashion. The dividers are provided with arcuate portions in the region of arcuate wall 46 to make the separation more effective.

In use, the apparatus motor 64 is energized and the propelling means roller 52 is continuously rotated during play. One or more players hit balls into the opening 24. The balls hit the target area 30 or housing walls and are guided by the first guiding means to the ball collection region at any point along the width of the propelling means 50. Depending on the position whereat they enter the propelling means, the balls are ejected through one of passages 90*a*, *b* or *c* and opening 26 toward the player or players at an angle determined by the angle of deflector 72. The players hit the balls back and the operation is repeated as long as the players are skillful enough to hit the balls through opening 24.

The foregoing detailed description has been given for clearness of understanding only and no unnecessary limitations should be understood therefrom as some modifications will be obvious to those skilled in the art.

We claim:

1. A game apparatus for receiving and launching aerial projectiles such as a ball without substantially reducing the velocity of the projectile, comprising:

a self-contained portable housing having a generally open vertical ball receiving area;

a smaller, ball target area mounted at the rear of said housing behind said ball receiving area and having a width several times the diameter of a ball for receiving a ball propelled through the ball receiving area;

a ball propelling means including a rotating cylinder mounted adjacent the target area and a concentric arcuate housing portion spaced from the surface of said cylinder at a distance less than the diameter of said ball;

a ball ejection opening below the ball receiving area; and guide means between said propelling means and said ejection opening for affecting the direction of a ball propelled by said propelling means, said guide means comprising a plurality of diverging dividers between the ball propelling means and ball ejection opening to define a plurality of exit paths of travel and movable means for varying the altitude of the propelled ball.

2. The game apparatus of claim 1 wherein said movable means includes a ball deflector at the ejection opening angularly adjustable about a horizontal axis for varying the vertical angle at which balls are ejected from the apparatus.

3. The game apparatus of claim 1 wherein said housing has a back wall defining a target area rearwardly of the ball propelling means, first ball guiding means comprising top and side walls extending forwardly of the back wall and propelling means, and a downwardly inclined bottom defining portion terminating near and about the top of the propelling means.

4. The game apparatus of claim 3 wherein the top, side and bottom defining portions define a front ball entrance of greater area than said target area.

5. A game apparatus for use with aerial projectiles such as table tennis balls and the like, including in combination, a housing having a ball target area at its rear portion having a width several times the diameter of a ball for receiving balls propelled into the area anywhere along the width of the area, ball propelling means located at the region of and below said target area for propelling a received ball away from the target area, said housing having walls defining a front ball entrance and guiding walls leading to the target area and propelling means, and having also ball guiding exit walls defining a forwardly extending ball discharge passage below the entrance and terminating in an ejection opening, said ball discharge passage including guide means comprising at least two divergent fins spaced inwardly of said walls and an adjustable deflector for varying the altitude of the propelled ball.

6. A game apparatus as claimed in claim 5 wherein said ball propelling means includes a cylinder and an arcuate housing end wall-bottom wall portions concentric with about 90° of the cylinder, said last-mentioned wall portions and discharge passage defining separate ball exit paths disposed at different angles.

7. A game apparatus as claimed in claim 5 including means controlling the ball propelling means to vary the ball ejection velocity.

8. A game apparatus as claimed in claim 5 including an upstanding lip at the ball entrance to restrain balls from escaping from said housing at said entrance.

* * * * *